US009863289B2

(12) United States Patent
Oh et al.

(10) Patent No.: US 9,863,289 B2
(45) Date of Patent: Jan. 9, 2018

(54) CVVT APPARATUS FOR ENGINE

(71) Applicants: Hyundai Motor Company, Seoul (KR); Kia Motors Corp., Seoul (KR)

(72) Inventors: Chung Han Oh, Seongnam-Si (KR); Min Su Park, Paju-Si (KR); Yun Seok Kim, Yongin-Si (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 23 days.

(21) Appl. No.: 14/952,314

(22) Filed: Nov. 25, 2015

(65) Prior Publication Data

US 2017/0022850 A1 Jan. 26, 2017

(30) Foreign Application Priority Data

Jul. 23, 2015 (KR) ..... 10-2015-0104647

(51) Int. Cl.
*F01L 1/34* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 2001/0471* (2013.01); *F01L 2001/34423* (2013.01); *F01L 2001/34426* (2013.01); *F01L 2001/34453* (2013.01); *F01L 2001/34456* (2013.01); *F01L 2001/34466* (2013.01)

(58) Field of Classification Search
CPC ..... F01L 1/3442; F01L 1/047; F01L 2001/34426; F01L 2001/34456; F01L 2001/0471; F01L 2001/34423; F01L 2001/34453; F01L 2001/34466
USPC ..... 123/90.17
See application file for complete search history.

(56) References Cited

U.S. PATENT DOCUMENTS

2013/0192551 A1* 8/2013 Hayashi ..... F01L 1/344 123/90.17

FOREIGN PATENT DOCUMENTS

| | | | |
|---|---|---|---|
| JP | 2010-190159 | A | 9/2010 |
| JP | 2014-185520 | A | 10/2014 |
| KR | 10-2008-0004534 | A | 1/2008 |
| KR | 10-2011-0132104 | A | 12/2011 |
| KR | 10-2014-0057169 | A | 5/2014 |

* cited by examiner

*Primary Examiner* — Zelalem Eshete
(74) *Attorney, Agent, or Firm* — Morgan, Lewis & Bockius LLP

(57) ABSTRACT

A continuous variable valve timing apparatus for an engine includes: a housing, a rotor installed to be rotatable relative to the housing and connected to a camshaft, a locking pin configured to restrict rotation of the rotor relative to the housing when pushed by an elastic force to move linearly and pass through a relatively rotating surface between the housing and the rotor, an elastic member installed to provide the elastic force, a valve bolt coupled to the camshaft through the housing and the rotor, wherein the valve bolt includes a release passage through which a release pressure provided through the camshaft is transferred to the locking pin via the rotor, and a valve means for selectively blocking or unblocking the release passage, and an actuator installed to actuate the valve means of the valve bolt according to an actuation displacement.

7 Claims, 4 Drawing Sheets

CVVT APPARATUS FOR ENGINE

CROSS REFERENCE TO RELATED APPLICATION

The present application claims priority of Korean Patent Application Number 10-2015-0104647 filed Jul. 23, 2015, the entire contents of which are incorporated herein for all purposes by this reference.

BACKGROUND OF THE INVENTION

Field of the Invention

The present invention relates to an CVVT (Continuous Variable Valve Timing) apparatus for an engine, and, more particularly, to a technology for fixing a phase of an CVVT apparatus in a specific state in an operating region in which a valve timing is not actively adjusted.

Description of the Related Art

When an engine is driven in an Atkinson cycle, compression work may be reduced and thus fuel efficiency may be improved. An CVVT apparatus is utilized to realize the Atkinson cycle in a typical Otto-cycle engine.

That is, when the closing of an intake valve in a conventional Otto-cycle engine is delayed using an CVVT apparatus, compared to that in a typical engine, a compression stroke, in which energy for compressing air is consumed when a piston moves toward a top dead point, is practically decreased. Thus, the compression work of the engine may be relatively reduced compared to when the intake valve is not closed due to a delay, so that fuel efficiently may be improved.

However, since the CVVT apparatus is generally operated by hydraulic pressure produced using the power of the engine, it is difficult to actively control the CVVT apparatus when the engine is started.

In addition, when a valve timing is not actively controlled by the CVVT apparatus in the operating region during the idling of the engine, it is advantageous to fuel efficiency since energy consumption is rather small.

Accordingly, the CVVT apparatus is in a default state in which the CVVT apparatus is not actively controlled when the engine is started or idles.

In the engine equipped with the CVVT apparatus, which is configured to adjust the phase of an intake camshaft enough to realize the Atkinson cycle, when the default state is formed in which the CVVT apparatus is not actively controlled by hydraulic pressure, the CVVT apparatus is maintained in the most delayed state by resistance to driving of the intake camshaft. In this case, since the intake valve is delayed and closed in the most delayed state, there is a lack of compression pressure, resulting in the faulty starting of the engine and the poor combustion during the idling of the engine.

Therefore, it is necessary to fix the CVVT apparatus in the state, in which the intake valve timing of the typical Otto-cycle engine is realized, in the operating region, in which the CVVT apparatus is not actively controlled, such as in the operating region when the engine is started or idles.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

Accordingly, the present invention has been made keeping in mind the above problems occurring in the related art and/or other problems, and the present invention is to provide an CVVT apparatus for an engine, in which the CVVT apparatus is capable of being fixed in a state, in which an intake valve timing of a typical Otto-cycle engine is realized, without provision of a working oil pressure, in an operating region, in which the CVVT apparatus is not actively controlled, such as in an operating region when the engine is started or idles, thereby enabling the engine to be smoothly and stably operated when the engine is started or idles. In addition, the present invention is to provide the CVVT apparatus for an engine, capable of being excellently mounted to a vehicle by minimizing a change in structure of a conventional CVVT apparatus, such that a conventional engine and manufacturing equipment thereof are minimally changed and the size of the engine is not increased or at least not increased substantially.

In accordance with one aspect of the present invention, an CVVT apparatus for an engine includes: a housing; a rotor installed to be rotatable relative to the housing and connected to a camshaft; a locking pin configured to restrict rotation of the rotor relative to the housing when pushed by an elastic force to move linearly and pass through a relatively rotating surface between the housing and the rotor; an elastic member installed to provide the elastic force; a valve bolt coupled to the camshaft through the housing and the rotor, wherein the valve bolt includes a release passage through which a release pressure provided through the camshaft is transferred to the locking pin via the rotor, and a valve means for selectively blocking or unblocking the release passage; and an actuator installed to actuate the valve means of the valve bolt according to an actuation displacement thereof.

A release pressure supply groove may be formed in a journal of the camshaft for supplying the release pressure to the release passage, and the camshaft may be formed with a communication hole through which the release pressure supply groove communicates with a space between a tip of the valve bolt and an inner portion of the camshaft.

An oil control valve for providing a hydraulic pressure, through which a rotation phase of the rotor relative to the housing is advanced or delayed, may be installed to an engine block equipped with the camshaft, and the release pressure may be supplied from the oil control valve through a block passage formed in the engine block to the release passage.

The oil control valve may be configured such that oil supplied from an oil pump passes through the block passage.

The locking pin may be installed in the rotor to be linearly movable toward or away from the housing, the housing may be formed with an insertion groove into which the locking pin is inserted, and the insertion groove may be formed at a position, into which the locking pin is inserted, in a phase of the rotor allowing the camshaft to realize an intake valve timing of a typical Otto-cycle engine.

The actuator may be an electronic actuator installed to pass through an engine cover facing the housing.

The valve means of the valve bolt may include a valve spool installed to be linearly movable within the valve bolt according to a linear displacement as the actuation displacement of the actuator, and a support spring to support the valve spool elastically toward the actuator.

As apparent from the description disclosed herein, the CVVT apparatus for an engine can be fixed in the state, in which the intake valve timing of the typical Otto-cycle engine is realized, without the provision of a working oil pressure, in the operating region, in which the CVVT apparatus is not actively controlled, such as in the operating region when the engine is started or idles, thereby enabling the engine to be smoothly and stably operated when the engine is started or idles. In addition, the CVVT apparatus for an engine can be excellently mounted to the vehicle by minimizing the change in structure of the conventional CVVT apparatus, such that the conventional engine and manufacturing equipment thereof are minimally changed and the size of the engine is not increased or at least not increased substantially.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other objects, features and advantages of the present invention will be more clearly understood from the following detailed description taken in conjunction with the accompanying drawings, in which:

FIGS. 3 and 4 are comparison views illustrating a state in which a valve means of a valve bolt is actuated according to an actuation displacement of an actuator, wherein FIG. 3 illustrates that the actuator is turned off, and FIG. 4 illustrates that the actuator is turned on.

DESCRIPTION OF PREFERRED EMBODIMENTS

Figure 1:
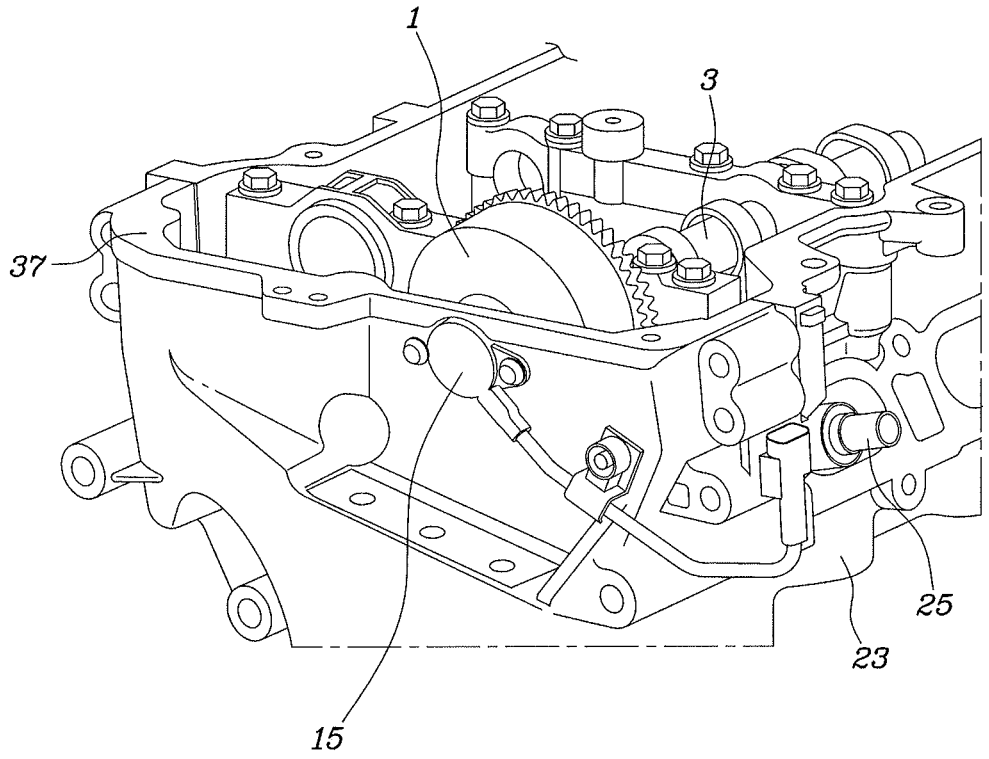
FIG. 1 is a view illustrating an installation state of an CVVT apparatus for an engine according to an embodiment of the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An CVVT apparatus for an engine according to the preferred embodiments of the present invention will be described below with reference to the accompanying drawings.

Referring to FIGS. 1 to 4, an CVVT apparatus for an engine according to an embodiment of the present invention includes a housing 1, a rotor 5, which is installed to be rotatable relative to the housing and is connected to a camshaft 3, a locking pin 7, which passes through a facing relatively rotating surface between the housing and the rotor by elastic force so as to restrict the rotation of the rotor relative to the housing by linear movement, an elastic member 9 installed to provide the elastic force, a valve bolt 13, which is coupled toward the camshaft through the housing and the rotor while forming a release passage 11, through which a release pressure provided through the camshaft is transferred to the locking pin via the rotor, and having a valve means for communication or blocking of the release passage, and an actuator 15 installed so as to actuate the valve means of the valve bolt according to the actuation displacement thereof.

The housing 1 is installed so as to be interlocked with a crankshaft of an engine by a power transfer mechanism such as a chain. An advance chamber and a delay chamber are formed between the rotor and the housing. The phase of the rotor relative to the housing is changed according to hydraulic pressures provided in the advance and delay chambers, and the phase of the camshaft, which is integrally connected to the rotor, may be ultimately changed relative to the housing and the crankshaft.

The locking pin 7 is installed to be linearly movable toward and/or away from the housing within the rotor. The housing is formed with an insertion groove 17 into which the locking pin is inserted. The insertion groove is preferably formed at a position, into which the locking pin may be inserted, in the phase of the rotor, which allows the camshaft to realize the intake valve timing of a typical Otto-cycle engine.

That is, in the state in which the locking pin 7 is inserted into the insertion groove 17 by the elastic force of the elastic member 9, the phase of the camshaft relative to the housing and the crankshaft is fixed to realize the intake valve timing of the conventional Otto-cycle engine even though a separate hydraulic pressure is not supplied to the advance or delay chamber. Therefore, intake air may be completely compressed even when the engine is started or idles, thereby enabling the engine to be stably and smoothly operated.

When the engine is, of course, placed in an operating situation that requires the CVVT apparatus to be actively operated, it is necessary to release the locking pin such that the rotor is in a rotatable state relative to the housing. To this end, the release pressure is supplied to the release passage 11.

Figure 2:
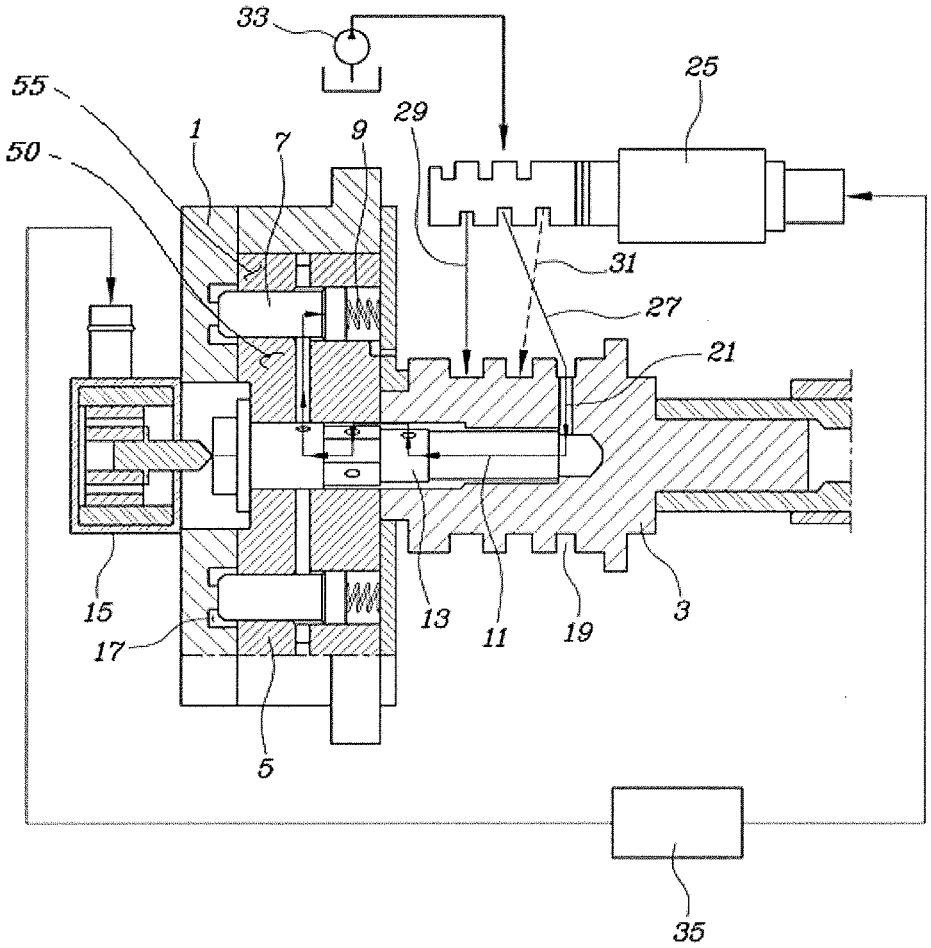
FIG. 2 is a view illustrating components of the CVVT apparatus for an engine according to an embodiment of the present invention.

In the illustrated embodiment, in order to supply the release pressure to the release passage, a release pressure supply groove 19 is formed in the journal of the camshaft, and the camshaft is formed with a communication hole 21 through which the release pressure supply groove communicates with a space defined between the tip of the valve bolt and the inner portion of the camshaft, as illustrated in FIG. 2.

In the illustrated embodiment, an oil control valve 25 for providing a hydraulic pressure, through which the rotation phase of the rotor 5 relative to the housing 1 is advanced or delayed, is installed to an engine block 23 equipped with the camshaft 3. The release pressure is supplied from the oil control valve through a block passage 27, which is formed in the engine block, to the release passage.

Figure 3:
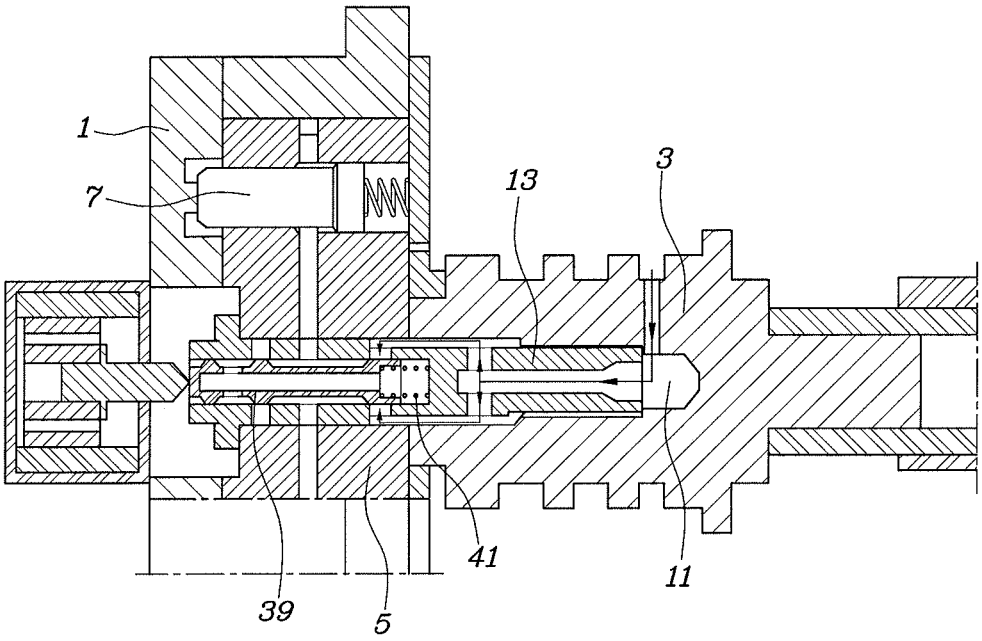
Figure 4:
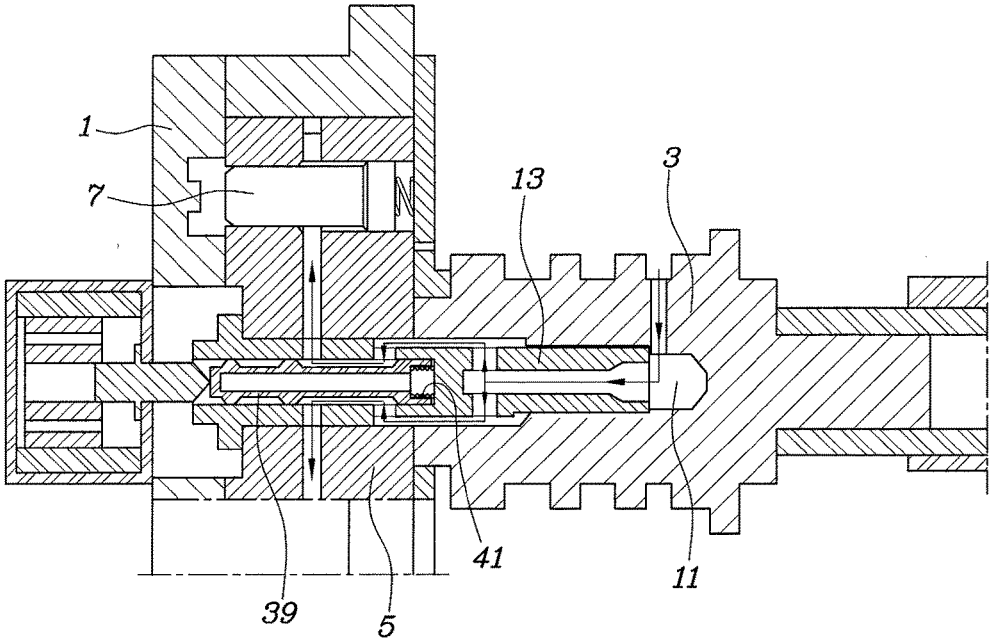

For reference, the block passage 27 is conceptually indicated by the arrow in FIG. 2, and the release passage 11 is indicated by the arrow in FIGS. 2 to 4. In addition, an advance passage 29 and a delay passage 31, through which hydraulic pressures are respectively supplied from the oil control valve 25 to the advance and delay chambers, are also indicated by the arrows in FIG. 2.

The oil control valve 25 is configured such that oil supplied from an oil pump 33 passes through the block passage 27.

That is, the oil control valve 25 is supplied with oil from the oil pump in order to control and supply the oil to the advance and delay passages. In this case, the oil supplied to the oil control valve is supplied, as it is, to the block passage without separate control.

Accordingly, when the pressure of oil supplied from the oil pump 33 is sufficiently increased, the release pressure is supplied toward the release passage through the block passage regardless of the control of the oil control valve. In this case, when a controller 35 operates the actuator 15, the release pressure reaches the locking pin 7, thereby allowing the locking pin 7 to be released.

The controller 35 controls the oil control valve 25 when the locking pin 7 is released, and adjusts the hydraulic pressures in the advance and delay chambers 50 and 55 so as to be adapted for the operating state of the engine, thereby performing CVVT control to realize an Atkinson cycle.

In some cases, the actuator 15 is an electronic actuator which is installed to pass through an engine cover 37 facing the housing.

Accordingly, since the actuator is installed so as almost not to protrude to the outside of the engine, compared to the related art, the engine can be excellently mounted to the vehicle.

Meanwhile, the valve means of the valve bolt 13 includes a valve spool 39, which is installed to be linearly movable within the valve bolt according to a linear displacement as the actuation displacement of the actuator, and a support spring 41 which is installed such that the valve spool is elastically supported toward the actuator.

That is, as illustrated in the comparison views of FIGS. 3 and 4, when no electric power is applied to the actuator 15, the release pressure is blocked as illustrated in FIG. 3, and thus the locking pin is maintained in the state of being inserted into the insertion groove. In addition, when electric power is applied to the actuator as illustrated in FIG. 4, the release pressure is supplied to the locking pin such that the locking pin is removed from the insertion groove against the elastic force of the elastic member. For reference, FIG. 4 illustrates that a state in which the locking pin is still not released.

According to the present invention as described above, by adding the release pressure supply groove 19 to the conventional camshaft journal, adding the block passage 27 to the engine block, and adding the valve bolt 13 and the actuator 15, the phase of the rotor relative to the housing can be fixed in a specific state under specific operating conditions such as starting or idling of the engine, and then be easily released when the operation of the CVVT apparatus is required. Consequently, it is possible to minimize a change in structure of the engine, stably and smoothly operate the engine in all operating regions thereof, and improve fuel efficiency through the CVVT control.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve timing (CVVT) apparatus for an engine, comprising:

a housing;

a rotor installed to be rotatable relative to the housing and connected to a camshaft;

an elastic member installed to provide an elastic force;

a locking pin configured to restrict rotation of the rotor relative to the housing when the locking pin is pushed by the elastic force of the elastic member to move linearly and pass through a relatively rotating surface between the housing and the rotor;

a valve bolt coupled to the camshaft through the housing and the rotor, wherein the valve bolt includes a release passage through which a release pressure provided through the camshaft is transferred to the locking pin via the rotor, and a valve means for selectively blocking or unblocking the release passage;

an actuator installed to actuate the valve means of the valve bolt according to an actuation displacement thereof;

an oil control valve for providing a hydraulic pressure, through which a rotation phase of the rotor relative to the housing is advanced or delayed;

a controller configured to operate the actuator to allow the locking pin to be released, and control the oil control valve when the locking pin is released; and an advance passage and a delay passage respectively supplying hydraulic pressures from the oil control valve to an advance chamber and a delay chamber through the camshaft, wherein each of the advance passage and the delay passage is separately formed from the release passage.

2. The CVVT apparatus according to claim 1, wherein a release pressure supply groove is formed in a journal of the camshaft for supplying the release pressure to the release passage, and the camshaft is formed with a communication hole through which the release pressure supply groove communicates with a space between a tip of the valve bolt and an inner portion of the camshaft.

3. The CVVT apparatus according to claim 1, wherein:

a block passage is formed in an engine block equipped with the camshaft such that the release pressure is supplied from the oil control valve through a block passage formed in the engine block to the release passage.

4. The CVVT apparatus according to claim 3, wherein the oil control valve is configured such that oil supplied from an oil pump passes through the block passage.

5. The CVVT apparatus according to claim 1, wherein:

the locking pin is installed in the rotor to be linearly movable toward or away from the housing;

the housing is formed with an insertion groove into which the locking pin is inserted; and the insertion groove is formed at a position, into which the locking pin is inserted, in a phase of the rotor allowing the camshaft to realize an intake valve timing of a typical Otto-cycle engine.

6. The CVVT apparatus according to claim 1, wherein the actuator is an electronic actuator installed to pass through an engine cover facing the housing.

7. The CVVT apparatus according to claim 1, wherein the valve means of the valve bolt comprises:

a valve spool installed to be linearly movable within the valve bolt according to a linear displacement as the actuation displacement of the actuator; and a support spring to support the valve spool elastically toward the actuator.

* * * * *